US005086516A

United States Patent [19]

Baxter et al.

[11] Patent Number: 5,086,516

[45] Date of Patent: Feb. 11, 1992

[54] COAT JACKET WITH DETACHABLE DECLARATIONS OF ALLEGIANCE

[76] Inventors: La Varr Baxter; Roy Baxter, both of 1916 Bangs Ave., Neptune, N.J. 07753

[21] Appl. No.: 579,731

[22] Filed: Sep. 10, 1990

[51] Int. Cl.[5] ..... A41D 1/02

[52] U.S. Cl. ..... 2/108; 2/115; 2/102; 2/246; 2/DIG. 6

[58] Field of Search ..... 2/108, 115, 102, 246, 2/69, DIG. 6, 85, 93; 40/586

[56] References Cited

U.S. PATENT DOCUMENTS

| | | | |
|---|---|---|---|
| 2,527,258 | 10/1950 | Kahn | 40/586 |
| 3,484,974 | 12/1969 | Culmone | 2/115 |
| 4,249,268 | 2/1981 | Berler | 2/115 |
| 4,277,848 | 7/1981 | Boehland | 2/115 |
| 4,354,282 | 10/1982 | Langdon | 2/115 |
| 4,513,454 | 4/1985 | Anderson et al. | 2/DIG. 6 |
| 4,611,355 | 9/1986 | Galanto et al. | 2/246 |
| 4,627,110 | 12/1986 | Tengs | 2/69 |
| 4,639,946 | 3/1987 | Koenig | 2/DIG. 6 |
| 4,697,362 | 10/1987 | Wasserman | 2/DIG. 6 |
| 4,710,981 | 12/1987 | Sanchez | 2/115 |
| 4,776,043 | 10/1988 | Coleman | 2/DIG. 6 |
| 4,873,726 | 10/1989 | Tapia | 2/DIG. 6 |
| 4,924,613 | 5/1990 | Levin | 40/586 |
| 4,975,985 | 12/1990 | Stimpson | 2/DIG. 6 |

OTHER PUBLICATIONS

"Self-Adhering Nylon Tapes", Journal of A.M.A. Maurice Gershman, M.D., p. 930, Oct. 18, 1958, vol. 168-No. 7.

*Primary Examiner*—Werner H. Schroeder
*Assistant Examiner*—Gloria Hale
*Attorney, Agent, or Firm*—Charles I. Brodsky

[57] ABSTRACT

A coat jacket is described, constructed as having an outwardly facing back portion, across the shoulder and waist sections—and down the sides—of which a plurality of adhesively securing fabric strips are attached in forming a frame. Any of a series of logos, insignias, pictorial representations, etc. are similarly provided with adhesively securing fabric strips along their edges, to mate with the coat jacket frame in presenting a jacket with detachable declarations of individual allegiance.

3 Claims, 1 Drawing Sheet

COAT JACKET WITH DETACHABLE DECLARATIONS OF ALLEGIANCE

FIELD OF THE INVENTION

This invention relates to coat jackets and, more specifically, to one which can be worn with detachable declarations of individual allegiance by a person professing his, or her, identification with a person, group or cause.

BACKGROUND OF THE INVENTION

As is well known and understood, one of the largest markets of clothing merchandise today is the sale of sporting and rock-type jackets which the person wears to show his, or her allegiance to a baseball or football team, or to an entertainment group. In such manner, a fan might be seen during a Summer's day in wearing a jacket emblazoned with the word "YANKEES" on the back, announcing his adoration of that baseball team. During the Winter, that same fan may, instead, be wearing a jacket emblazoned "STEELERS", announcing his adoration of Pittsburgh, as his favorite professional football team. When going from outdoors concert to concert, the true fan might wear on one night, a jacket depicting and announcing his, or her, allegiance to "2 LIVE CREW", while on another night, it might be a jacket showing and claiming a love for "THE GRATEFUL DEAD", and, again, on yet another night, "KISS".

As will be readily understood, having to always buy additional jackets as allegiances change can become quite expensive—and, even if allegiances stay the same, pictorial representations, insignias, and logos for the same team, group or cause (e.g."SAVE THE DOPHINS") become more modern, or otherwise change regularly.

SUMMARY OF THE INVENTION

As will become clear hereinafter, this constantly having-to-buy new jackets is obviated—and through the use of adhesively securing fabric strips and separate pictorial representations, insignias, logos, etc., which can be detachably affixed to the jacket. As will be seen, the coat jacket of the present invention is described as having an outwardly facing back portion, across the shoulder and waist sections—and down the sides—of which a plurality of adhesively securing fabric strips are attached in forming a frame. Any of a series of these logos, insignias, pictorial representations, etc. are similarly provided with adhesively securing fabric strips along their edges, to mate with the coat jacket frame in presenting the jacket with these detachable declarations of allegiance. When it comes time to attend different events, in accordance with the invention, all that is required is the removal of these detachably affixed declarations of allegiance, and the substitution of the logo, insignia, pictorial representation, etc. of the new event to be attended.

As will become clear from the following description, the adhesively securing fabric strips utilized in forming the jacket frame are attached to the back section of the jacket by the application of a fabric glue along their edges and then sewn in place with the adhesively securing fabric strips facing outwardly in forming the frame. The logo, insignia, pictorial representation, etc. is provided, at its underside, with a similar frame of outwardly facing adhesively securing fabric strips, secured to the underside only by sewing and dimensioned so as to cause the frame of the jacket stripping to match with the frame on the underside of the picture to be then attached. As will become clear, by locating the adhesively securing fabric stripping at the edges of the underside portion of the picture, once the matching alignment is made the overall appearance would be that of the coat jacket carrying the declaration of allegiance, and presenting the appearance that it is a unitized manufacture. However, the wearer knows that this is not in fact the situation, but which results in a significant cost savings in not having to buy separate jackets for each occasion or event.

In accordance with a preferred embodiment of the invention Velcro® stripping is employed for the adhesively securing fabric materials—which is of measurable importance in permitting the detachment of the logo, insignia, pictorial representation, etc. from the jacket on those occasions where the jacket is then to be washed, or otherwise cleaned. This, it will be seen, permits the declaration of allegiance to be kept fresh-looking, besides being able to update the display on the jacket as more current advertising is developed.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
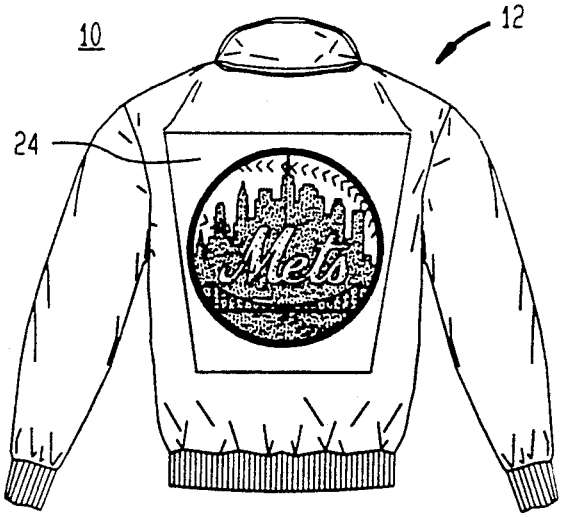
FIG. 1 shows a sporting type , or rock, jacket bearing a typical pictorial representation identifying the wearer's allegiance to a particular team, group or cause, constructed in accordance with the invention.
Figure 2:
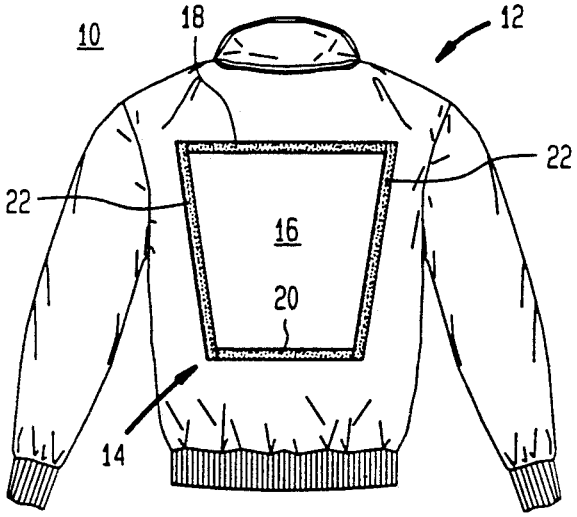
FIG. 2 is the sporting type, or rock, jacket with the pictorial representation detached, and showing the adhesively securing fabric strips used in forming the frame construction of FIG. 1.
Figure 3:
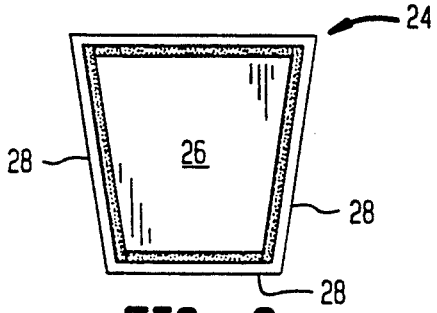
FIG. 3 illustrates the adhesively securing fabric strips on the underside of the pictorial representation to be secured to the frame of the jacket of FIG. 2.

Referring to the drawing, the coat jacket 10 is shown as having an outwardly facing back portion 12 incorporating a plurality of adhesively securing Velcro® fabric strips 14 forming a frame 16. In accordance with a preferred construction, the Velcro® strips 14 extend horizontally from shoulder to shoulder and for a coat jacket of "regular" size, would be some 18" long and some 2" wide. The Velcro® stripping 14 extending across the waist area, would be of a lesser length, approximately 12" for a "regular" sized jacket, and with stripping down the sides, from the shoulder to the waist, in forming the frame 16. In forming this frame with a denim type jacket, the shoulder stripping 18 may be first secured, followed by the waist stripping 20, and then the side stripping 22, (shown as overlapping both the shoulder and waist strippings 18, 20). In forming this frame 16, the individual Velcro® strips are first coated with a fabric glue on its back, or non-adhesive surface, and then pressed against the back portion of the coating material. So as to more securely hold the Velcro® stripping 14 in place, the strippings 18, 20, and 22 are then additionally sewn to the back portion 12, and along the edges of the stripping material.

As is also shown, the underside of the pictorial representation 24 is provided with similar Velcro® type stripping, but which need only be of a narrower width than the fabric strips 18, 20, or 22, and in this case only sewn to the underside 26, without any need for the reinforcing fabric glue. (As will be readily apparent, for jacket sizes that are "long" or "short", the dimensioning for the lengths of the Velcro® stripping 14 would obviously be different than in the illustrative example, and the jacket sizes would be different.) With the adhesive stripping secured along the edges 28 of the underside 26 of the pictorial representation 24, the pictorial representation is then aligned so that the fabric stripping from the representation 24 matches up with, and mates with the edges of the shoulder stripping 18, the waist stripping 20, and the side stripping 22 of the jacket frame 16. Pressing one against the other then holds the two in place.

As will be apparent, when it is desired to remove the pictorial representation—either for purposes of washing the jacket, or to substitute the representation with a different pictorial representation, logo or insignia (depending upon the sporting event, concert, or cause to be declared)—it becomes just a simple thing to peel away the representation 24 and to then simply wash the jacket or replace the representation 24 with a new one. Reinforcing the fabric strips 18, 20, 22 by the glue securing them to the jacket strengthens their securement, and holds them in place, so as not to be ripped away when the pictorial representation 24 is peeled off.

(Although one might think that an alternative method of detachably securing the logo, insignia or pictorial representation to a jacket might equally be made by a zipper matching of the jacket to the detachable emblem, it will soon be appreciated how much more costly such arrangement might be, and how much more time consuming and cumbersome it would be to connect the two together. At the same time, such matching would be quite apparent and obvious to the eye, and would not at all give the appearance of the jacket {with its representation} being a single entity. Such alternative really then, is not a plausible substitution.)

While there has been described what is considered to be a preferred embodiment of the present invention, it will be readily appreciated by those skilled in the art that modifications can be made without departing from the scope of the teachings herein of having an outwardly facing back portion of a coat jacket framed of a plurality of adhesively securing fabric strips to accept pictorial representations that are similarly provided with stripping in announcing a declaration of a wearer's allegiance, in a detachable, replaceable manner. For at least such reason, therefore, resort should be had to the claims appended hereto for a true understanding of the scope of the invention.

We claim:

1. The combination comprising:

a coat jacket having an outwardly facing back portion;

a first plurality of adhesively securing fabric strips affixed to said back portion to form an outwardly facing frame;

means providing on a first side thereof one of a pictorial representation, logo and insignia according to a wearer's preference;

and a second plurality of adhesively securing fabric strips affixed to a second side of said providing means;

with said second plurality of strips removably attaching said providing means to said jacket via said frame;

wherein said back portion of said coat jacket includes a shoulder section and a waist section, and wherein said first plurality of adhesively securing fabric strips extends both across said sections and between said sections;

wherein said first plurality of strips are of a given width and are affixed to said back portion of said coat jacket by fabric guide and then by a sewing thereto;

wherein said providing means includes a plurality of side edges and wherein said second plurality of adhesively securing fabric strips are of a narrower width than said first plurality of strips and are affixed to said second side of said providing means between said side edges thereof, by a sewing thereto.

2. The combination of claim 1 wherein at least one of said first plurality of strips extends across said shoulder section and at least another one extends across said waist section of said coat jacket, and wherein at least two of said first plurality of strips extend between said shoulder and waist sections and overlap end portions of said first plurality of said strips.

3. The combination of claim 2 wherein the overlapped end portions are sewn.

* * * * *